US005319812A

United States Patent [19]

Hanrahan et al.

[11] Patent Number: 5,319,812

[45] Date of Patent: Jun. 14, 1994

[54] VERTICALLY MOVABLE BATHROOM

[76] Inventors: Peter J. Hanrahan, 2115 E. 1st St., Brooklyn, N.Y. 11223; E. Kevin Keegan, 30 Blenheim Dr., Manhasset, N.Y. 11030

[21] Appl. No.: 66,798

[22] Filed: May 25, 1993

[51] Int. Cl.[5] ..... A47K 4/00; E03C 1/01

[52] U.S. Cl. ..... 4/663; 4/321; 4/661; 187/1 R

[58] Field of Search ..... 4/254, 300, 480, 321, 4/322, 323, 645, 661, 662, 663, 667; 187/1 R

[56] References Cited

U.S. PATENT DOCUMENTS

| | | | |
|---|---|---|---|
| 2,037,895 | 4/1936 | Gugler | 4/663 X |
| 3,594,825 | 7/1971 | Reid | 4/663 |
| 4,091,473 | 5/1978 | Matthews et al. | 4/667 X |
| 4,296,506 | 10/1981 | Stoute, Sr. et al. | 4/480 |
| 4,678,062 | 7/1987 | Sumka | 187/1 R |
| 5,065,462 | 11/1991 | Romano | 4/662 X |

*Primary Examiner*—Robert M. Fetsuga
*Attorney, Agent, or Firm*—Morgan & Finnegan

[57] ABSTRACT

A vertically movable bathroom can be moved between a plurality of vertically spaced user stations, such as the floors in a high rise building. In one embodiment a freight elevator in a high rise building is modified to include complete bathroom facilities that are accessible to disabled persons, such that the facilities can be provided to any floor of the building. The modified elevator also includes first aid supplies, oxygen, a stretcher, etc., to make such supplies available throughout the building. Fire safety facilities, including a self contained sprinkler system and an express control to cause the elevator to travel to an exit floor without opening on any intermediate floors, provide a safe means of egress from the building in the event of a fire or other emergency.

20 Claims, 6 Drawing Sheets

VERTICALLY MOVABLE BATHROOM

FIELD OF THE INVENTION

This invention relates to a bathroom facility and, in particular, to a vertically movable bathroom that can serve a number of vertically spaced user stations, such as the floors in a high rise building.

BACKGROUND OF THE DISCLOSURE

There is an increasing desire in the United States and throughout the world to improve the accessibility of both public and private facilities to disabled persons. For many years disabled people, particularly those who are unable to walk, have been denied access to career opportunities, entertainment, etc., because they were unable to either gain access to, or remain for long periods of time in, the buildings that provide such employment and services.

One of the difficulties faced by disabled persons is that standard bathroom facilities are not designed for their use. For example, standard bathrooms do not provide wheelchair access, since the stalls are usually too small and the doors are too narrow. Furthermore, even bathrooms which have been modified to provide wheelchair access usually do not provide necessary facilities for severely disabled persons such as, e.g., lift devices which can raise such a person out of the wheelchair and position him or her over the toilet.

The increased awareness of the needs of disabled persons has resulted in many building owners voluntarily renovating their facilities to provide access for the disabled. Laws have also been enacted at both the state and federal levels to require building owners to make their buildings accessible to the disabled. However, the high cost associated with such renovations has prevented and/or delayed compliance with such laws and has inhibited voluntary renovations.

For example, it can cost tens of thousands of dollars to renovate the bathroom facilities on a single floor of a typical office building to meet the minimum requirements of the Americans with Disabilities Act. Thus, for an average high rise building, such renovations can total hundreds of thousands or even millions of dollars. Such a large investment may not be possible for many building owners and may seem unwarranted where there may be only a few disabled people working in the building.

It has been suggested that building owners renovate one or two floors to provide bathroom facilities with disabled access, and then require all disabled persons working in the building to travel to a renovated floor. However, it is inherently unfair to require a disabled person to travel many floors to use a bathroom, while other building occupants have facilities on each floor. Furthermore, some federal and/or state regulations may require that bathroom facilities for the disabled be made available on each floor of a building.

In addition to the need to provide disabled bathroom facilities on each floor of a building, it is also desirable to provide first aid equipment (e.g., stretcher, oxygen, bandages, etc.) on each floor. However, the cost of providing such equipment on every floor of a large building is prohibitive.

Finally, there is a need to provide a safe means of egress from a tall building in the event of fire or other emergency, especially for disabled persons. Conventional elevators are not safe in fires, and disabled persons are often stranded in high buildings where the only means of escape is a stairway that they cannot use.

SUMMARY OF THE INVENTION

The disadvantages of the prior art are overcome by the present invention which features a bathroom facility that can be moved between a number of vertically spaced user stations. In the preferred embodiment, a freight elevator in an office building is modified to include complete disabled accessible bathroom facilities, first aid equipment and fire safety equipment, thereby making such facilities available to every floor in the building.

In one aspect, the present invention includes a toilet facility comprising: a toilet and apparatus for moving the toilet between a plurality of vertically spaced user stations. The toilet can be moved only along some predetermined path. e.g., a vertical path. The apparatus for moving the toilet can be a standard elevator, and preferably a freight elevator.

In another aspect, the invention includes: a movable bathroom having an enclosed structure with an interior space; a toilet attached to the enclosed structure in the interior space; and apparatus for moving the enclosed structure between a plurality of vertically spaced user stations, wherein the enclosed structure is movable only along a predetermined path.

The invention also includes a sink that is attached to the structure in the interior space, and an apparatus for flushing the toilet. The flushing apparatus includes a supply tank containing a liquid and a pipe connecting the tank to the toilet such that the liquid can flow from the supply tank to the toilet.

The supply tank is positioned above the toilet, and includes a bottom surface having an opening, and an elongated pipe extending from outside the tank through the opening and into the tank. The elongated pipe has a first opening located in the tank and a second opening located outside and beneath the tank in the interior space of the enclosed structure. The pipe is vertically movable with respect to the tank such that the first opening of the pipe can be lowered toward the bottom surface of the tank.

In normal use, the the elongated pipe is positioned in the tank such that the first opening is above an upper surface of the liquid located in the tank. When the pipe is lowered to position the first opening below the upper surface of the liquid, a portion of the liquid flows down the pipe and emerges from the pipe through the second opening. The second opening of the pipe comprises a plurality of small diameter holes to disperse liquid passing through the second opening, like, e.g., a shower or sprinkler head.

The bathroom of the invention also includes a lift to assist disabled users of the bathroom, the lift having apparatus that will: (1) raise the user vertically; (2) position the user over the toilet; and (3) lower the user onto the toilet. The bathroom of the invention further includes a first aid kit including medical supplies and a supply of oxygen. A collapsible stretcher is removably secured to an interior wall of the enclosed space.

A call device located at each user station causes the bathroom to travel to a particular user station. Alternatively, a plurality of remote call devices can be used, each of which is to be provided to one of a plurality of users. Each remote call device, when activated by a particular user, is operative to cause the bathroom to move vertically to a user station associated with the particular user. Each of the remote call devices includes a display for indicating to the user whether the bathroom is currently being used by another user.

The bathroom has a door allowing access to the interior space by a user and a lock to prevent access to the interior space during use.

The invention includes a disposal tank having an interior space for receiving and storing waste from the toilet and sink, and a refrigeration unit for reducing the temperature of the interior space of the disposal tank.

A text telephone is positioned in the interior space and can be used for emergency calls. A fire strobe and alarm is also positioned in the interior space.

The preferred embodiment of the invention, described in detail below, will make a variety of facilities available to each floor of a multifloor building for a fraction of the cost associated with installing such facilities on every floor.

DETAILED DESCRIPTION OF A PREFERRED EMBODIMENT

Figure 1:
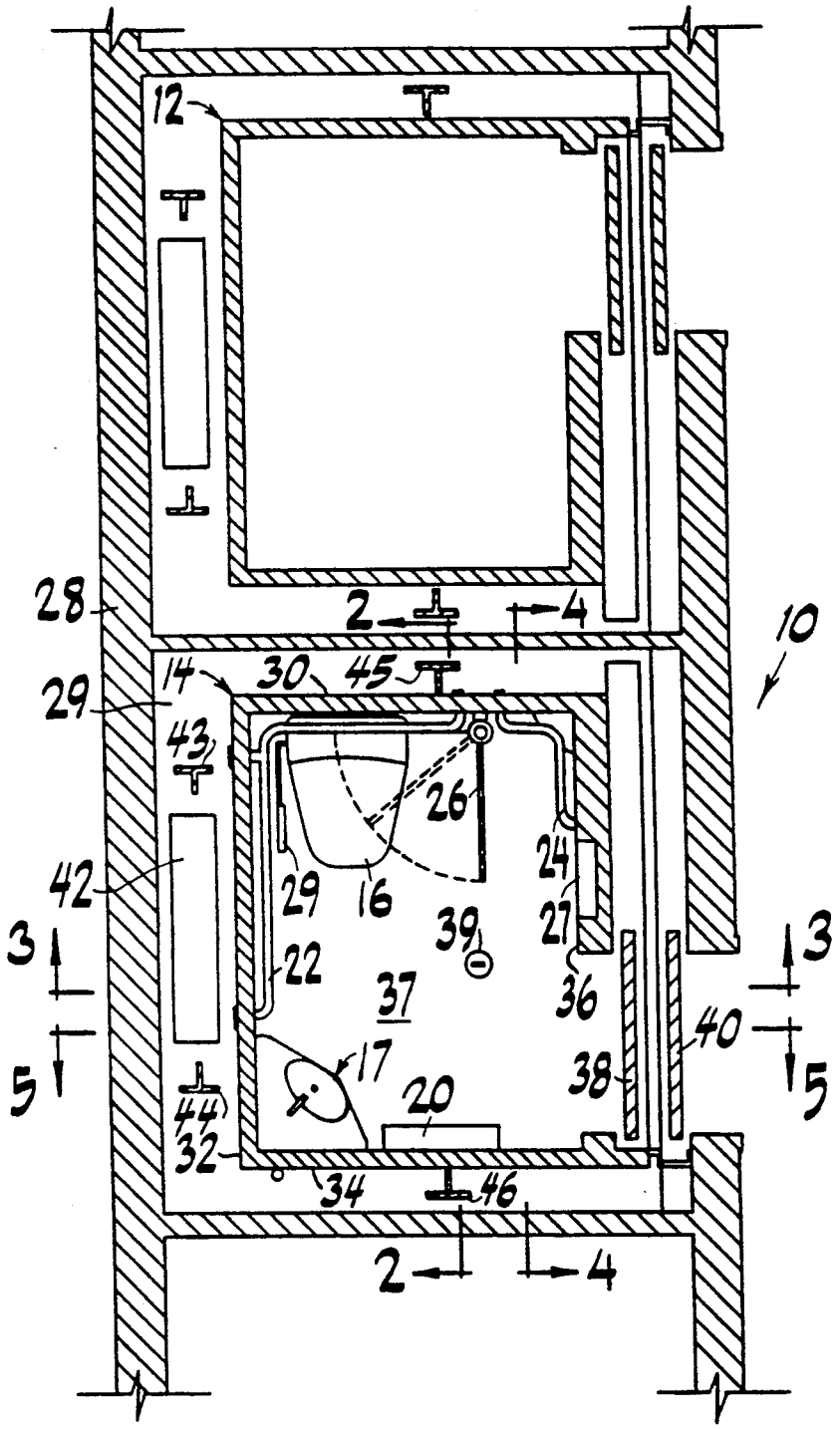
FIG. 1 is a cross-sectional plan view of an elevator bank in a building having an elevator that has been modified to include a vertically movable bathroom and medical facility according to one embodiment of the invention.

Referring to FIG. 1, an elevator bank 10 of a multifloor building has a number of elevators, including standard elevator 12 and modified elevator 14. As is explained in detail below, elevator 14 has been modified to include complete toilet facilities for the disabled, emergency first aid equipment, and fire safety equipment, to thereby provide these facilities to each floor of the building. Elevator 14 has also been modified to provide a safe means of escape in the event of a fire or other emergency.

Modified elevator 14 includes a toilet 16 (also commonly referred to as a "water closet", as well as by other names), a sink 17 and a first aid box 20, containing assorted medical supplies. Grab bars 22, 24 are provided to assist a user to position him or herself over toilet 16. Similarly, an electric lift 26 can be used by more severely disabled persons who are unable to use the grab bars. Lift 26 (described in more detail below) is movable as shown by the dashed lines. A flush handle 29 flushes toilet 16.

A control panel 27 includes a number of standard and novel features, described below in conjunction with FIG. 4, including a privacy lock that prevents the elevator doors from opening when the facility is being used.

Standard elevator equipment shown in FIG. 1 includes: a series of connected walls generally identified as 28 that define the elevator shafts, including shaft 29 through which elevator 14 passes; elevator walls 30, 32, 34 and 36; floor 37; interior elevator door 38; exterior elevator door 40 (one of which is on each floor); counterweight 42; counterweight guide rails 43, 44; and elevator guide rails 45, 46. Other standard elevator components (electronic control systems, etc.) are not shown as they are well known to those of ordinary skill in the art.

A valve 39 is positioned in floor 37, and is used in conjunction with a waste tank, described in more detail below.

Figure 2:
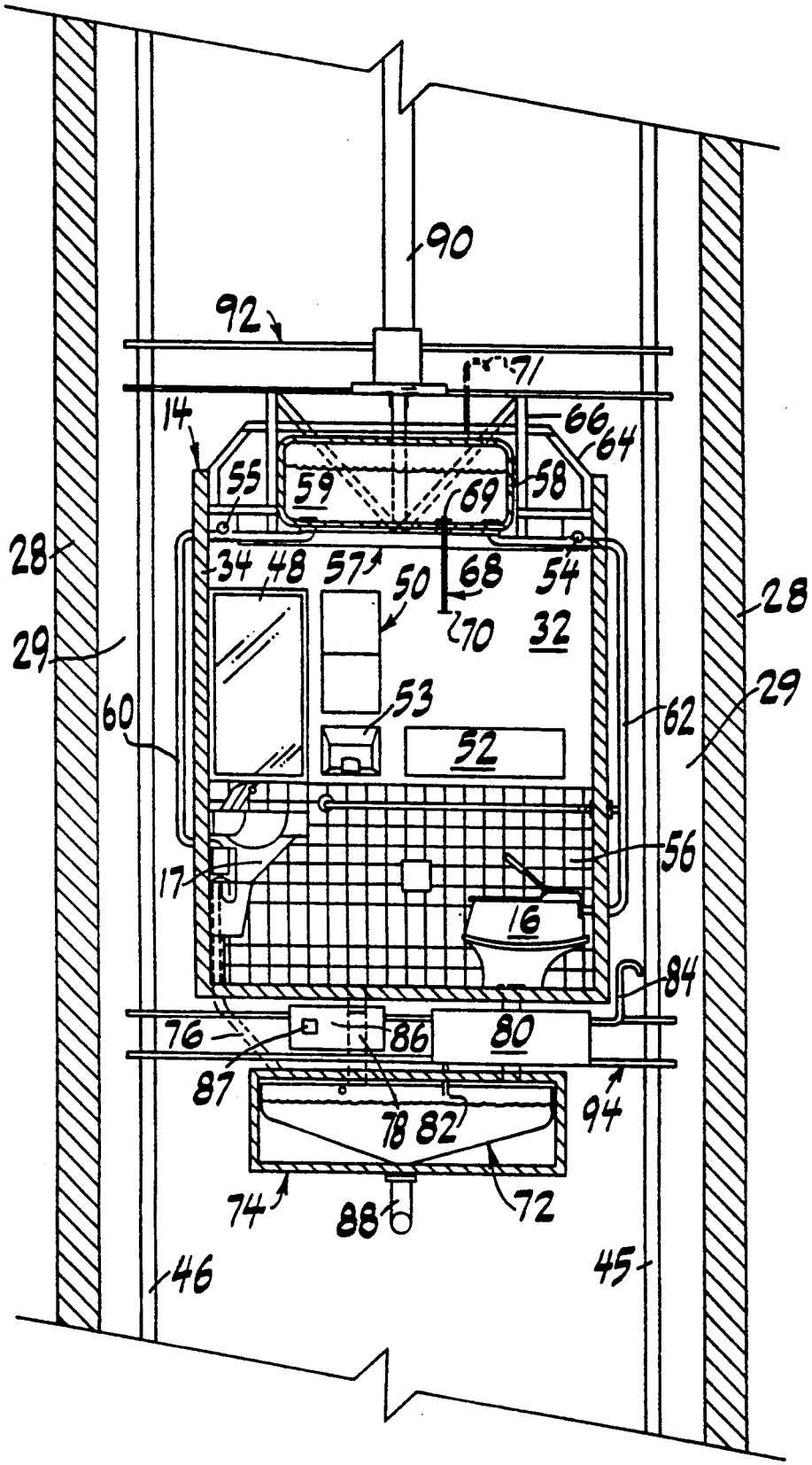
FIG. 2 is a cross-sectional view of the vertically movable bathroom shown in FIG. 1, taken along line 2—2.

FIG. 2 is a cross-sectional view of the vertically movable bathroom shown in FIG. 1, taken along line 2—2. (Throughout the figures, a component that is shown in more than one figure is labelled with the same number in each figure.) Attached to wall 32 is a mirror 48, and an oxygen compartment 50 that includes an oxygen tank and a number of masks for use in a fire emergency. An instruction panel 52 is also attached to wall 32 and contains instructions in various languages (including braille). The instructions can include, e.g., information on how to use the facility and what to do in case of an emergency. A standard hand dryer 53 is also provided, as are lights 54, 55. A standard tile surface 56 is provided along the interior walls of the elevator.

Positioned above a ceiling 57 of elevator 14 is a water supply tank 58 that contains a supply of water 59 that is used in toilet 16 and sink 17 (although another suitable liquid could be used instead of water). A pipe 60 connects the interior of the tank 58 to sink 17 and a similar pipe 62 connects tank 58 to toilet 16. Tank 58 is secured above ceiling 57 beneath a roof 64 of elevator 14 with support structure 66.

Tank 58 also includes a water supply/sprinkler pipe 68 that has an upper opening 69 positioned inside tank 58 and a lower opening 70 positioned in the interior of elevator 14 Pipe 68 is vertically movable such that upper opening 69 can be raised above the upper surface of water 59 or lowered such that it is submerged in water 59. Opening 70 includes a sprinkler head having a number of small diameter openings, which can be removed to allow pipe 68 to be connected to a water pump (not shown) used to refill tank 58. A pipe 71 serves to vent the interior of tank 58.

A waste tank 72 is attached to the bottom of elevator 14 by means of support structure 74. The interior of tank 72 is connected by a pipe 76 to the drain of sink 17 and by a pipe 78 to valve 39 in floor 37, which can be used to empty tank 72. A vent filter 80 vents air from the interior of tank 72 by means of pipes 82 and 84. A refrigeration unit 86, having a thermostat 87, cools the interior of tank 72 to reduce odors. A clean out valve and pipe 88 is positioned at the bottom of tank 72 to provide an alternate means for emptying tank 72.

Additional standard elevator equipment is shown in FIG. 2 and includes elevator support cables 90, upper support structure 92 and lower support structure 94.

Figure 3:
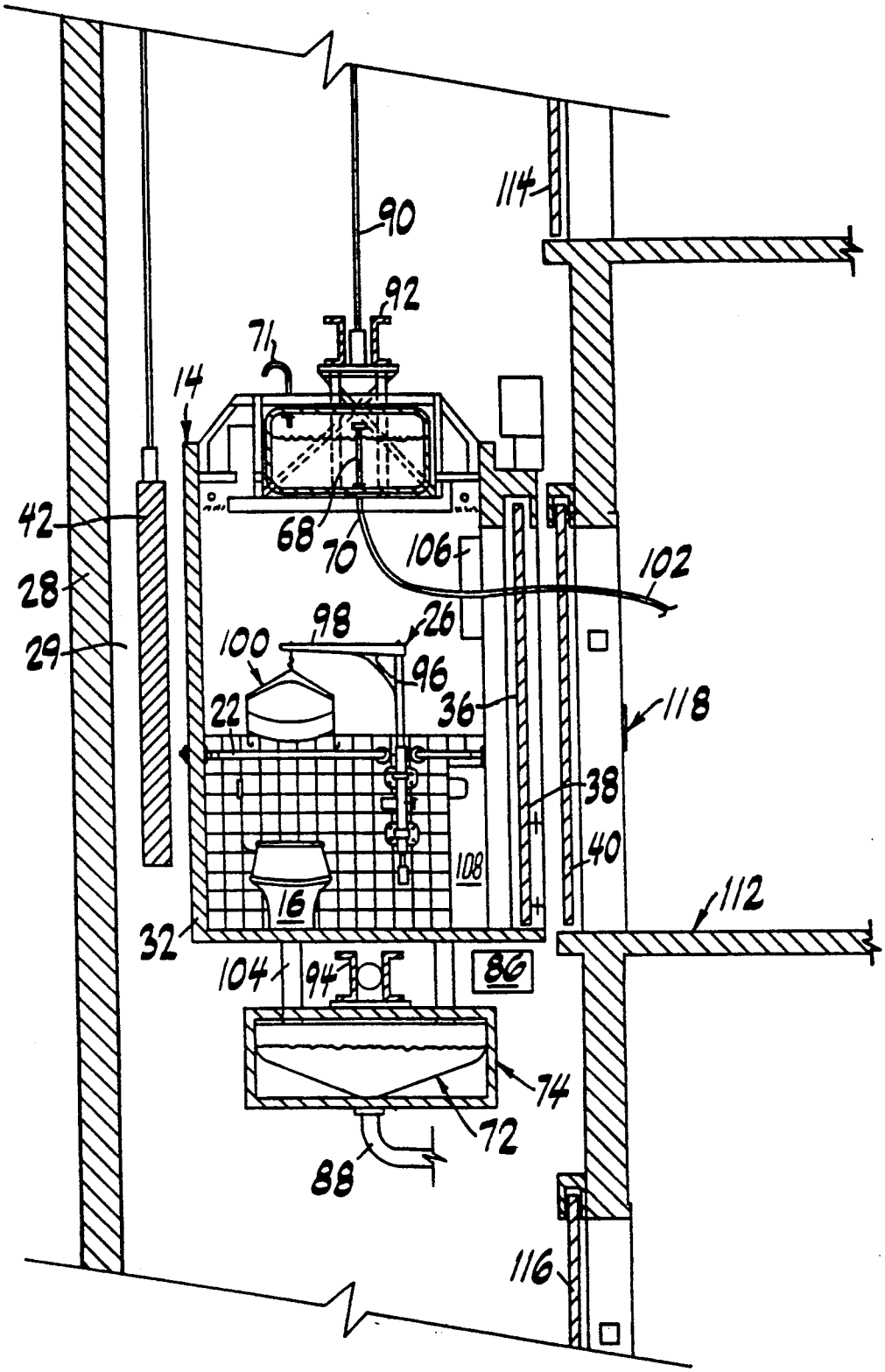
FIG. 3 is a cross-sectional view of the vertically movable bathroom shown in FIG. 1, taken along line 3—3.

FIG. 3 is a sectional view taken along line 3—3 in FIG. 1. Lift 26 is shown in greater detail and includes an electrically powered bar 96 mounted to wall 30 that is pivotal and vertically movable. A horizontal cross bar 98 is attached to bar 96 and supports a harness 100 that is used to secure the disabled person. Lift 26 is used to raise the disabled person out of the wheelchair and place him or her over toilet 16.

Supply/sprinkler pipe 68 is shown in FIG. 3 in its highest vertical position. A supply hose 102 is shown connected to bottom opening 70 of pipe 68 and is used to refill water supply 59. Also shown in FIG. 3 is a drain pipe 104 that drains toilet 16 into waste tank 72. A collapsible stretcher 106 is attached to wall 36, as is a medical waste disposal can 108.

Portions of three vertically spaced floors are shown in FIG. 3. Elevator 14 is positioned at a first floor 112 such that its internal door 38 is aligned with external door 40. Portions of similar external doors 114 and 116, for the floors immediately above and below floor 112, respectively, are also shown.

A call station 118 is located at each floor and can be either a standard button activated call station or can be key activated. A key can be provided to only those authorized to use renovated elevator 14. A display panel on station 48 can provide information to a user, including whether the bathroom is occupied and its location.

Figure 4:
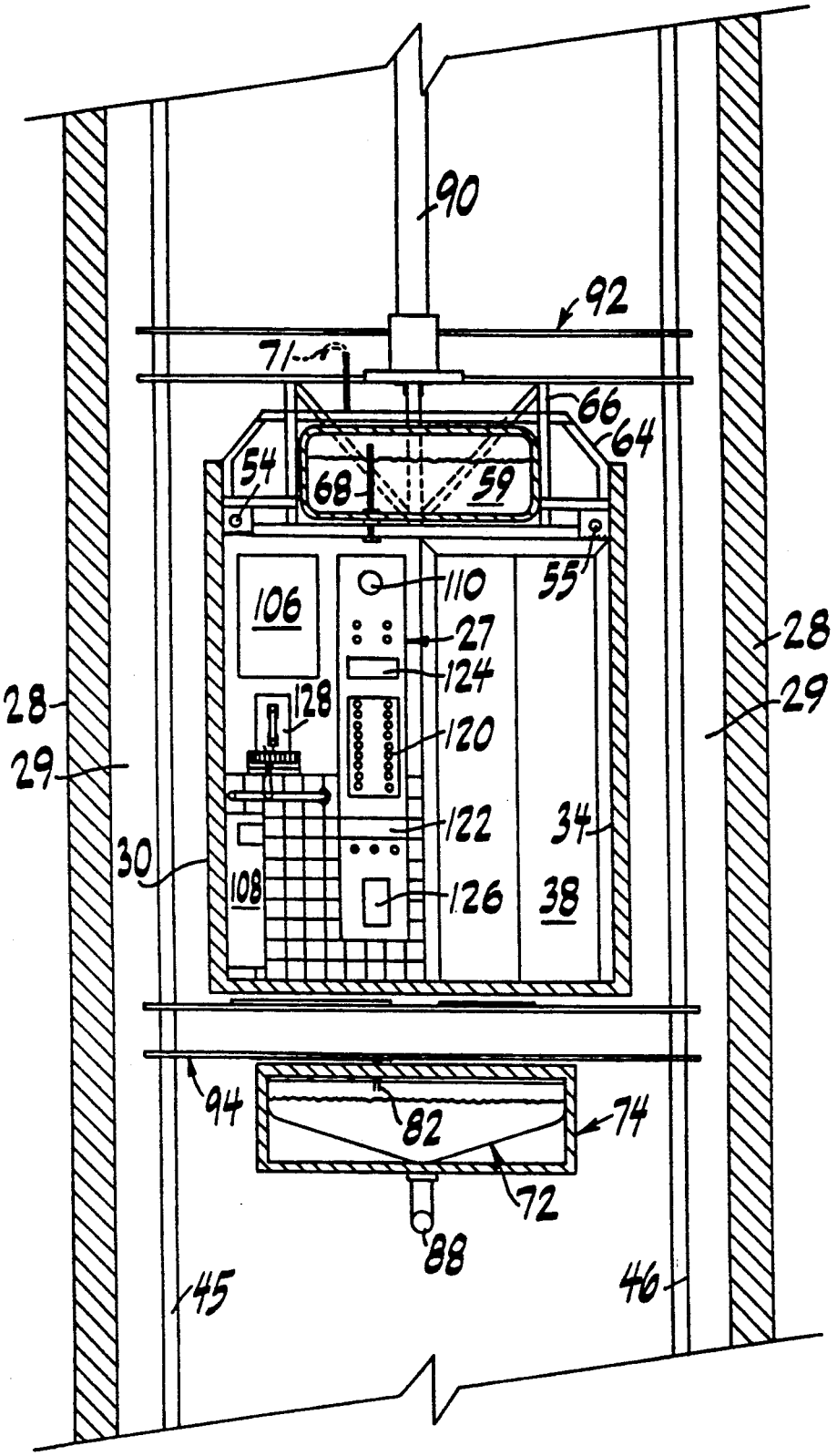
FIG. 4 is a cross-sectional view of the vertically movable bathroom shown in FIG. 1, taken along line 4—4.

FIG. 4 is a cross-sectional view taken along line 4—4 in FIG. 1. Control panel 27 is shown in more detail and includes a speaker 110 to announce emergency information to a user, as well as buttons 120 that include both buttons found in standard elevators (emergency stop, alarm, floor call buttons etc.), as well as other buttons described in more detail below.

A voice synthesizer and text display unit 122 enables messages to be delivered visually or audibly. Standard locked fire equipment boxes 124, 126 are also provided. An emergency call text telephone 128 enables communication with authorities in an emergency using voice and/or a keypad.

Figure 5:
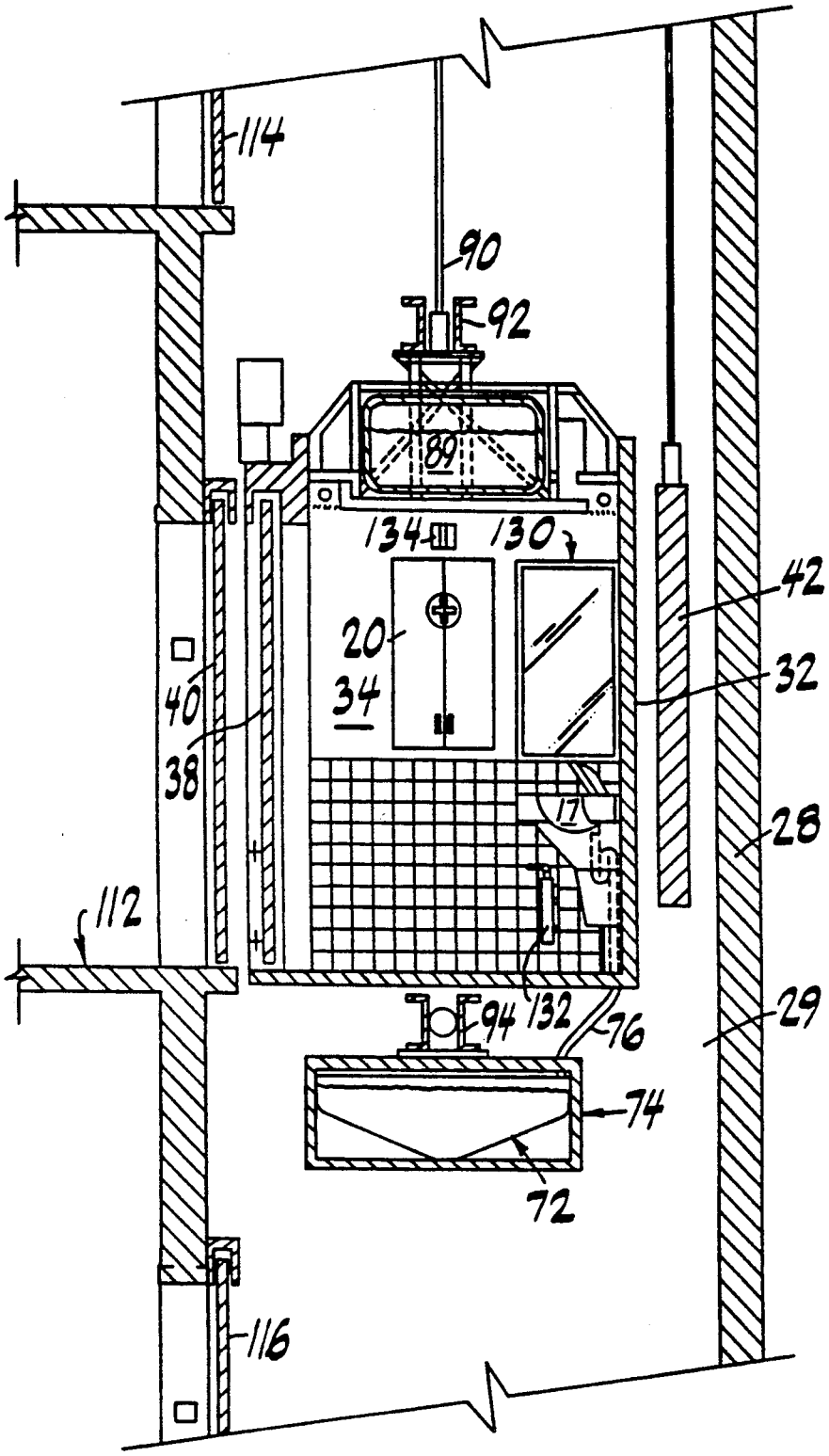
FIG. 5 is a cross-sectional view of the vertically movable bathroom shown in FIG. 1, taken along line 5—5.

FIG. 5 is a cross-sectional view taken along line 5—5 in FIG. 1. A second mirror 130 is mounted to wall 34 above sink I7. A fire extinguisher 132 is removably mounted beneath sink 17. A fire alarm and strobe light 134 is mounted to wall 34 above first aid box 20.

In operation, a disabled or other authorized user of the modified elevator of the invention calls the elevator using one of call stations 118. Call station 118 displays information to the user such as the location of elevator 14 and whether it is currently in use. Once the elevator arrives at the user's floor, the user gains access through doors 38,40.

Before using the facility a user can move the elevator to a different floor using control panel 27 and can lock the doors to ensure privacy during use, using one or more of buttons 112. For safety reasons, authorized Fire Department personnel would be able to override the privacy lock to gain access to the elevator in an emergency.

In a fire emergency, elevator 14 provides a safe means of escape from the building for disabled or other persons. Control panel 27 includes an emergency express button which, once activated, causes the elevator to travel directly to an exit floor (e.g., the lobby or basement), without stopping on any intermediate floor. Standard elevators are unsafe in fire emergencies since they may open on a floor that is on fire, injuring the elevator occupants. The express feature of elevator 14 eliminates this danger.

Furthermore, sprinkler pipe 68, when pulled down to its lowest vertical position, will drain water 59 from tank 58, and shower the water on the interior of elevator 14. This self-contained sprinkler provides an extra measure of safety in a fire emergency.

Increased fire safety is also realized by thoroughly sealing the elevator such that smoke in the elevator shaft will not be able to penetrate into the interior of the elevator. Standard sealing techniques are used.

Modified elevator 14 also serves as a mobile first aid facility, bringing medical supplies to any floor in a building in an emergency. Oxygen, drugs, and other potentially life saving supplies can be used in a medical emergency as the victim is being moved to an exit floor and/or during the delay before professional medical help can arrive.

Thus, the modified elevator of the preferred embodiment illustrated in FIGS. 1–5 will provide a variety of facilities to every floor in a building for approximately the cost of providing such facilities on a single floor.

Figure 6:
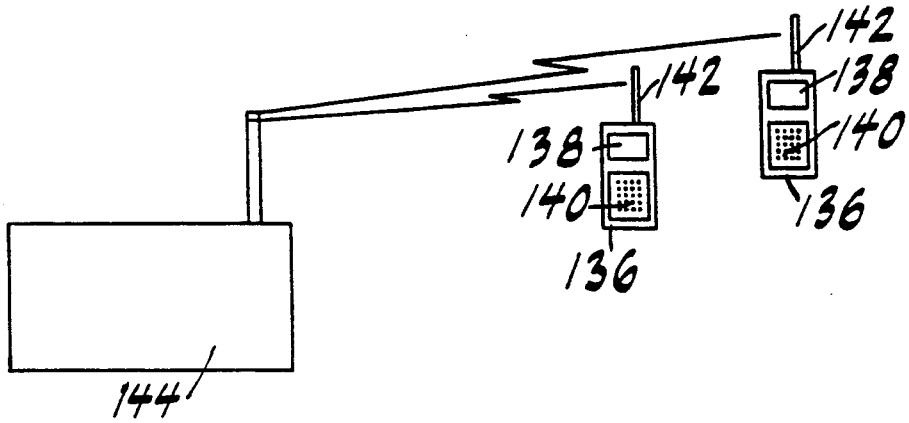
FIG. 6 is a schematic view of a remote calling system according to a second embodiment of the invention.

A second embodiment of the invention, directed to the means for calling the elevator to a particular floor, is illustrated in FIG. 6. Two remote call units 136 are shown (although any number could be used), and each includes a display panel 138 and a keypad 140 having a number of input buttons. Each unit 136 can communicate to a central processor 144 using standard data transmission circuits contained within the unit, and an antennae 142.

One of remote units 136 is distributed to each authorized user of the modified elevator. When a user wishes to call the modified elevator to his or her floor, the user enters a call command using keypad 140. A signal is sent to central processor 144, which determines if the elevator is available, or if it is being currently used. If it is available, the modified elevator is sent to a predetermined floor associated with that user, and the user is informed by means of display 138 that the facility is available for his or her use. If the modified elevator is not currently available, the user is so informed. The central computer can inform the user, by means of, e.g., an audible signal generated by the remote unit, when the facility becomes available.

Keypad 140 can also receive other information from the user. For example, the user can designate a particular floor where the modified elevator is to be sent.

Instead of the radio type remote units shown in FIG. 6, other remote means for calling the elevator could be used, including, e.g., a telephone.

Any standard elevator can be modified according to the present invention, with freight elevators usually being the most practical choice. Freight elevators are typically larger than passenger elevators, and have access to all floors in the building. Passenger elevators are sometimes arranged in banks of elevators, with the elevators in each bank having access to only a limited number of floors. Furthermore, some buildings have one or more elevator shafts that have been fireproofed, and the choice of an elevator operating in one of these shafts would further increase the fire safety of the modified elevator.

Other embodiments of the invention are within the scope of the appended claims, as will be apparent to those skilled in this art. For example, the waste tank is shown in the figures as having two different valves for removing waste from the tank, using, e.g., a hose. However, it may be desirable for sanitary reasons to make the entire waste tank removable. Thus, during servicing of the facility the tank would be removed and replaced with a clean tank, and the used tank could be thoroughly cleaned at an off site facility.

What is claimed is:

1. A movable bathroom for use in a structure having a plurality of substantially vertically spaced user stations, comprising:

an enclosed structure having an interior space;

a toilet integrally attached to said enclosed structure in said interior space; and means for moving said enclosed structure along only a substantially vertical predetermined path between said user stations.

2. The bathroom of claim 1 wherein said enclosed structure comprises an elevator.

3. The bathroom of claim 2 wherein said elevator comprises a freight elevator.

4. The bathroom of claim 1 wherein said predetermined path is vertical.

5. The bathroom of claim 1 further comprising a sink attached to said structure in said interior space.

6. The bathroom of claim 1 further comprising means for flushing said toilet, said means for flushing comprising a supply tank containing a liquid and a pipe connecting said tank to said toilet such that said liquid can flow from said supply tank to said toilet.

7. The bathroom of claim 6 wherein said supply tank is positioned above said toilet and wherein said supply tank comprises:

a bottom surface having an opening;

an elongated pipe extending from outside said tank through said opening and into said tank, said elongated pipe having a first opening located in said tank and a second opening located outside and beneath said tank in said interior space of said enclosed structure;

wherein said pipe is vertically movable with respect to said tank such that said first opening of said pipe can be lowered toward said bottom surface of said tank.

8. The bathroom of claim 7 wherein said elongated pipe is positioned in said tank such that said first opening is above an upper surface of said liquid located in said tank and wherein said pipe is vertically movable to position said first opening below said upper surface of said liquid such that a portion of said liquid flows down said pipe and emerges from said pipe through said second opening.

9. The bathroom of claim 8 wherein said second opening of said pipe comprises a plurality of small diameter holes to disperse liquid passing through said second opening.

10. The bathroom of claim 1 further comprising a lift to assist disabled users in said interior space, said lift comprising means for raising said user vertically, means for positioning said user over said toilet, and means for lowering said user onto said toilet.

11. The bathroom of claim 1 further comprising a first aid kit including medical supplies and a supply of oxygen.

12. The bathroom of claim 1 further comprising call means located at each user station that causes said bathroom to travel vertically to a particular user station.

13. The bathroom of claim 1 further comprising a plurality of remote call means, each of which is to be provided to one of a plurality of users, said call means, when activated by a particular user, being operative to cause said bathroom to move vertically to a user station associated with said particular user.

14. The bathroom of claim 13 wherein each of said remote call means comprises a display for indicating to a said user whether said bathroom is currently being used by another said user.

15. The bathroom of claim 1 further comprising a door allowing access to said interior space by a user and a means for locking said door to prevent access to said interior space.

16. The bathroom of claim 1 comprising a disposal tank having an interior space for receiving and storing waste, and means for reducing the temperature of said interior space of said disposal tank.

17. The bathroom of claim 1 further comprising a collapsible stretcher removably secured to an interior wall of said enclosed structure.

18. The bathroom of claim 1 further comprising a text telephone positioned in said interior space.

19. The bathroom of claim 1 further comprising a fire strobe and alarm positioned in said interior space.

20. The bathroom of claim 1 wherein said user stations are aligned vertically.

* * * * *